US007025230B1

(12) United States Patent
Salmela

(10) Patent No.: US 7,025,230 B1
(45) Date of Patent: Apr. 11, 2006

(54) HEATED FLUID DISPENSER

(75) Inventor: Juha K. Salmela, Citrus Heights, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 328 days.

(21) Appl. No.: 10/642,033

(22) Filed: Aug. 15, 2003

(51) Int. Cl.
*B67D 5/00* (2006.01)

(52) U.S. Cl. ..... 222/146.2; 222/146.5; 222/383.1; 222/385

(58) Field of Classification Search ..... 222/146.2, 222/146.5, 372, 380, 383.1, 385
See application file for complete search history.

(56) References Cited

U.S. PATENT DOCUMENTS 2,755,000 A * 7/1956 Parre ..... 222/129.4
3,084,613 A * 4/1963 Maxson ..... 99/282
6,003,733 A * 12/1999 Wheeler ..... 222/146.5
6,056,157 A 5/2000 Gehl et al.
6,223,944 B1 5/2001 Gehl et al.
6,419,121 B1 * 7/2002 Gutierrez et al. ..... 222/146.5
6,837,397 B1 * 1/2005 Lassota ..... 222/129.3

* cited by examiner

*Primary Examiner*—J. Casimer Jacyna
(74) *Attorney, Agent, or Firm*—Townsend and Townsend and Crew LLP

(57) ABSTRACT

Embodiments of the present invention are directed to a dispensing apparatus for dispensing a heated fluid or flowable food product from a package while maintaining the product at or above a preset elevated temperature. In one embodiment, an apparatus for dispensing a flowable product from a product package through a dispensing outlet at or above a preset elevated temperature comprises a container in which to dispose the product package. The container includes a gas inlet and a gas outlet. A dispensing outlet is provided to dispense the flowable product from the product package, and is disposed adjacent the gas outlet. A pump is coupled between the product package and the dispensing outlet to pump the flowable product from the product package to the dispensing outlet. A heated gas flow controller is configured to direct a heated gas flow in the container to heat the product package, the pump, and the dispensing outlet. The heated gas flow includes gas flowing into the container via the gas inlet and gas flowing out of the chamber via the gas outlet adjacent the dispensing outlet.

11 Claims, 5 Drawing Sheets

HEATED FLUID DISPENSER

CROSS-REFERENCES TO RELATED APPLICATIONS NOT APPLICABLE

BACKGROUND OF THE INVENTION

The present invention relates generally to dispensing apparatus and, more particularly, to an apparatus for dispensing a flowable product at an elevated temperature. The flowable product includes a fluid that may or may not contain particulates, such as cheese sauces, chili, other condiments, and the like.

It is often desirable to dispense a condiment such as cheese sauce, mustard, catsup, and other flowable food products from a product container. To prevent bacterial growth in low acid food products, such products are maintained at or above an elevated temperature, typically about 140° F. or higher, after the container is opened. Often the food products are available in flexible packages or bags, and are dispensed from such packages.

There remains a need for an efficient, effective, and easy-to-use apparatus for dispensing food products from packages at or above a preset elevated temperature. One of the challenges is to maintain the temperature of the food product at various locations from the package to the dispensing nozzle or head at or above the preset elevated temperature. Failure to do so even in a relatively small region, especially at the dispensing nozzle outlet, may pose health risks by allowing bacterial growth to occur.

BRIEF SUMMARY OF THE INVENTION

Embodiments of the present invention are directed to a dispensing apparatus for dispensing a heated fluid or flowable food product from a package while maintaining the product at or above a preset elevated temperature. The apparatus provides a container including a product compartment for housing the product package, and a dispensing mechanism to pump the product from the product package to a dispensing nozzle. Heated air is circulated around the product package and the dispensing mechanism including the dispensing outlet to maintain the temperature of the product from the product package to the dispensing outlet at or above a preset elevated temperature.

An aspect of the present invention is directed to an apparatus for dispensing a flowable product from a product package through a dispensing outlet at or above a preset elevated temperature. The apparatus comprises a container in which to dispose the product package. The container includes a gas inlet and a gas outlet. A dispensing outlet is provided to dispense the flowable product from the product package, and is disposed adjacent the gas outlet. A pump is coupled between the product package and the dispensing outlet to pump the flowable product from the product package to the dispensing outlet. A heated gas flow controller is configured to direct a heated gas flow in the container to heat the product package, the pump, and the dispensing outlet. The heated gas flow includes gas flowing into the container via the gas inlet and gas flowing out of the chamber via the gas outlet adjacent the dispensing outlet.

In some embodiments, the product package is disposed in a package compartment in the container with space around the product package to permit the heated gas flow through the space around the product package. The pump includes a flow channel disposed between the product package and the dispensing outlet, and the flow channel is disposed inside the container. The gas outlet comprises an annular outlet disposed around the dispensing outlet. The heated gas flow controller comprises a fan heater which draws outside air from outside the container via the gas inlet, heats the air, and circulates the heated air in the container. A portion of the heated air exits the container through the gas outlet and a remaining portion of the heated air is recirculated through a return air plenum to the fan heater. The fan heater generates a positive pressure inside the container which is higher than a pressure outside the container. A filter disposed at the gas inlet.

In accordance with another aspect of the invention, the apparatus comprises a container in which to dispose the product package, and a dispensing outlet to dispense the flowable product from the product package. A pump is coupled between the product package and the dispensing outlet to pump the flowable product from the product package to the dispensing outlet. A heater is configured to heat air in the container. A fan is configured to draw outside air from outside the container via the gas inlet which is heated by the heater, and to circulate the heated air in the container along flow paths adjacent the product package, the pump, and the dispensing outlet.

In some embodiments, a portion of the heated air exits the container through the gas outlet and a remaining portion of the heated air is recirculated through a return air plenum to the fan heater. The gas outlet comprises an annular outlet disposed around the dispensing outlet. The product package is disposed in a package compartment in the container with space around the product package to permit the heated gas flow through the space around the product package.

In accordance with another aspect of the invention, the apparatus comprises a container in which to dispose the product package, a dispensing outlet to dispense the flowable product from the product package, a pump coupled between the product package and the dispensing outlet to pump the flowable product from the product package to the dispensing outlet, and a heater configured to heat air in the container. The apparatus further comprises a mechanism for generating a positive pressure inside the container which is higher than a pressure outside the container to cause the heated air in the container to flow adjacent the product package, the pump, and the dispensing outlet.

In accordance with yet another aspect of the invention, a method of dispensing a flowable product at or above a preset elevated temperature comprises disposing a product package in a container; pumping a flowable product to produce a product flow from the product package to a dispensing outlet to dispense the flowable product outside the container; and directing a heated gas flow in the container along flow paths adjacent the product flow to heat the flowable product from the product package to the dispensing outlet. The heated gas flow includes gas flowing adjacent the dispensing outlet to maintain the flowable product at or above the preset elevated temperature at the dispensing outlet.

In some embodiments, the heated gas flow includes gas flowing through a gas outlet to exit the container, and the gas outlet comprises an annular outlet disposed around the dispensing outlet. Directing the heated gas flow comprises drawing outside air from outside the container via a gas inlet of the container, heating the air, and circulating the heated air in the container. The heated gas flow includes a portion of heated gas flowing through a gas outlet to exit the container, and a remaining portion of the heated air which is recirculated through the container. Directing the heated gas flow comprises generating a positive pressure inside the container which is higher than a pressure outside the container. The product package is disposed in a package compartment in the container with space around the product package to permit the heated gas flow through the space around the product package.

DETAILED DESCRIPTION OF THE INVENTION

Figure 1:
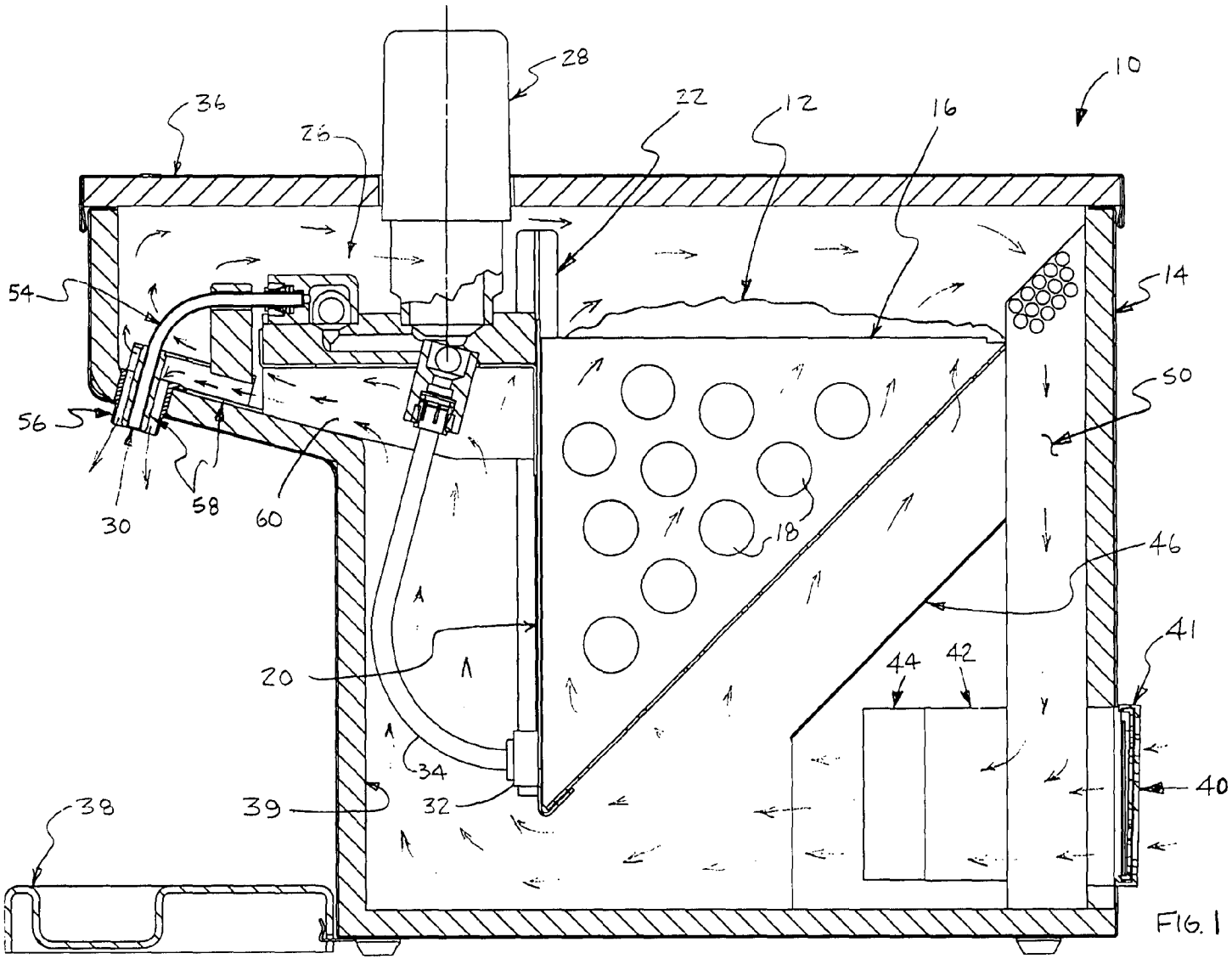
FIG. 1 is a partial cross-sectional view of a dispensing apparatus according to an embodiment of the present invention.
Figure 2:
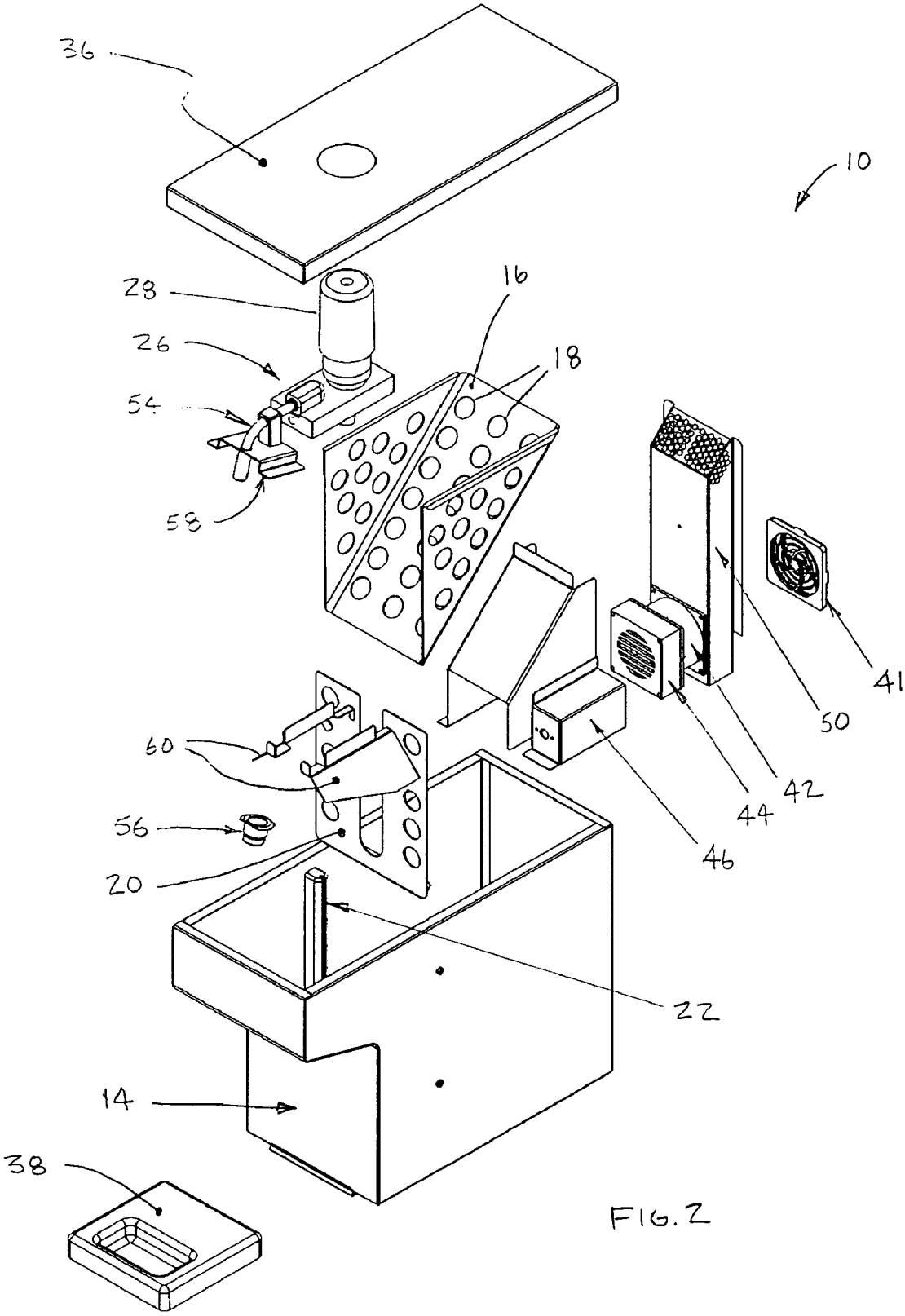
FIG. 2 is an exploded perspective view of the dispensing apparatus of FIG. 1.

FIGS. 1 and 2 show a dispensing apparatus 10 for dispensing a heated, flowable product contained in a product package 12 such as a bag. The product package 12 is disposed in a container 14. Heated air or gas is circulated inside the container 14 to maintain the temperature of the product at or above a preset minimum temperature. The container 14 desirably includes a product package holder 16 on which to place the package 12. The product package holder 16 advantageously includes a plurality of apertures 18 to permit the heated air to come into contact with the package 12. A part of the product package holder 16 is formed by a pump holder bulkhead panel 20 which is slidably supported on a bulkhead slide rail 22. A pump 26 is supported by the pump holder bulkhead panel 20, and includes a pump plunger 28 which can be moved up and down by a user to pump the product from the product package 12 to a dispensing outlet 30. The inlet 32 of a pump inlet tube 34 is connected to the outlet of the product package 12. Any suitable pump may be used, such as the pump disclosed in U.S. Pat. No. 6,405,897, which is incorporated herein by reference in its entirety. A top cover 36 is placed on top of the container 14 to form an enclosure. A drip tray 38 may be provided below the dispensing outlet 30 and attached to the container 14. The container 14 desirably includes thermal insulation 39 throughout.

The apparatus 10 employs a fan heater to provide a flow of heated gas or air inside the container 14. In the embodiment as shown in FIGS. 1 and 2, an outside air inlet 40 is provided along a side of the container 14 to permit outside air to flow into the container 14. The air inlet 40 typically includes an air filter 41. The outside air is drawn into the container 14 by a fan 42 disposed near the air inlet 40, and heated by a heater 44 disposed adjacent to and downstream of the fan 42. A protective heat shield 46 may be provided between the heater 44 and the product package 12 to prevent excessive heat from damaging the product package 12. The heater 44 may be a thermostatically controlled axial fan heater and the fan 42 may be a continuously running tube axial fan.

To provide recirculation of the air inside the container 14, a return air plenum 50 is disposed near the air inlet 40 to recirculate air inside the container 14 to the fan 42. This provides an efficient and effective heated air flow within the container 14. As best seen in FIG. 1, the apparatus 10 is designed for mixing of the outside air and the recirculated air, and circulation of the heated air around the product container 12 and components of the pump 26 and dispensing outlet 30 along which the product flows to maintain the temperature of the product from the product container 12 to the dispensing outlet 30 at or above the preset elevated temperature. As shown in FIG. 1, a relatively small portion of the heated air flows around the product outlet nozzle tube 54 out of the container 14 through a hood 56 adjacent the dispensing outlet 30. This ensures that the temperature of the product does not fall below the preset elevated temperature at the dispensing outlet 30. A metal tube and shroud 58 may be provided to direct the heated air flow to the hood 56 and the dispensing outlet 30. A pair of wings 60 may also be provided on both sides of the shroud 58 to channel the heated air toward the hood 56 and dispensing outlet 30.

Because of the air flow out of the container 14, the outside air flow through the inlet 40 into the container 14 is needed to generate a positive pressure inside the container 14 which is higher than the pressure outside the container 14. As seen in FIG. 1, the heated air is driven by the fan and heater 42, 44 to flow around the product package 12 elevated by the product package holder 16 and positioned away from the bottom and side walls of the container 14. The apertures 18 of the holder 16 allow the heated air to contact the product package 12. The product package 12 is preheated before being placed inside the apparatus 10, desirably at or above the preset elevated temperature. The heated air also flows around the flow channel of the pump 26, which includes the pump inlet tube 34, the product outlet nozzle tube 54, and the body of the pump 26 between the pump inlet tube 34 and the outlet nozzle tube 54. The hood 56 provides an annular outlet for the heated air to flow around the dispensing outlet 30 and exit the container 14. A relative small portion of the heated air flows out of the container 14 through the outlet provided by the hood 56. The remaining air is recirculated through the return air plenum 50 to the fan and heater 42, 44.

The apparatus 10 is easy to assemble and disassemble. The top cover 36 is removable. The pump 26, pump holder bulkhead panel 20, and product package holder 16 can be lifted out of the container 14 with relative ease for cleaning or the like. The product package 12, with the pump assembly 26 and inlet tube 34 preconnected to the inlet tube 34, can be installed by simply lowering it straight into the package holder 16. By placing the package outlet near the bottom of the package holder 16, the maximum amount of product can be drawn out from the package 12 to minimize waste. For safety, the apparatus 10 desirably provides thermal overload fuse should the thermostat for the heater 44 fail and a ground fault type electrical plug for any electrical shorts.

Figure 6:
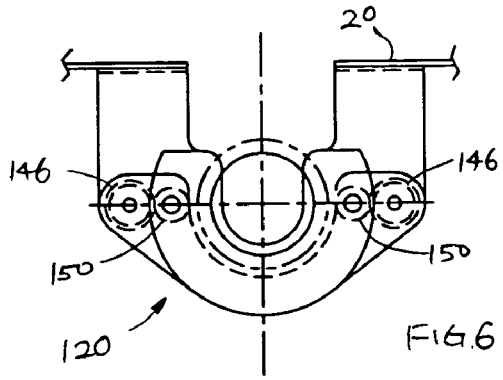
FIG. 6 is a top plan view of the pump in the dispensing apparatus of FIG. 4.
Figure 4:
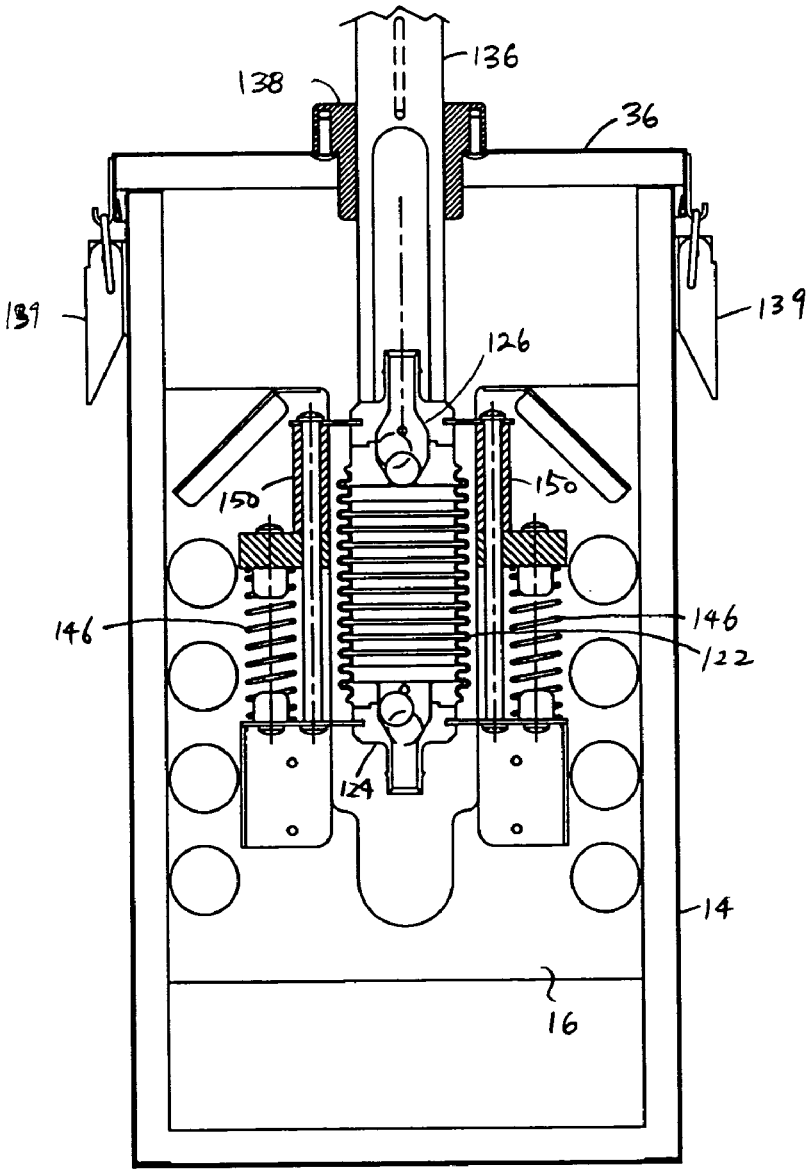
FIG. 4 is a front elevational view of a dispensing apparatus according to another embodiment of the present invention.
Figure 5:
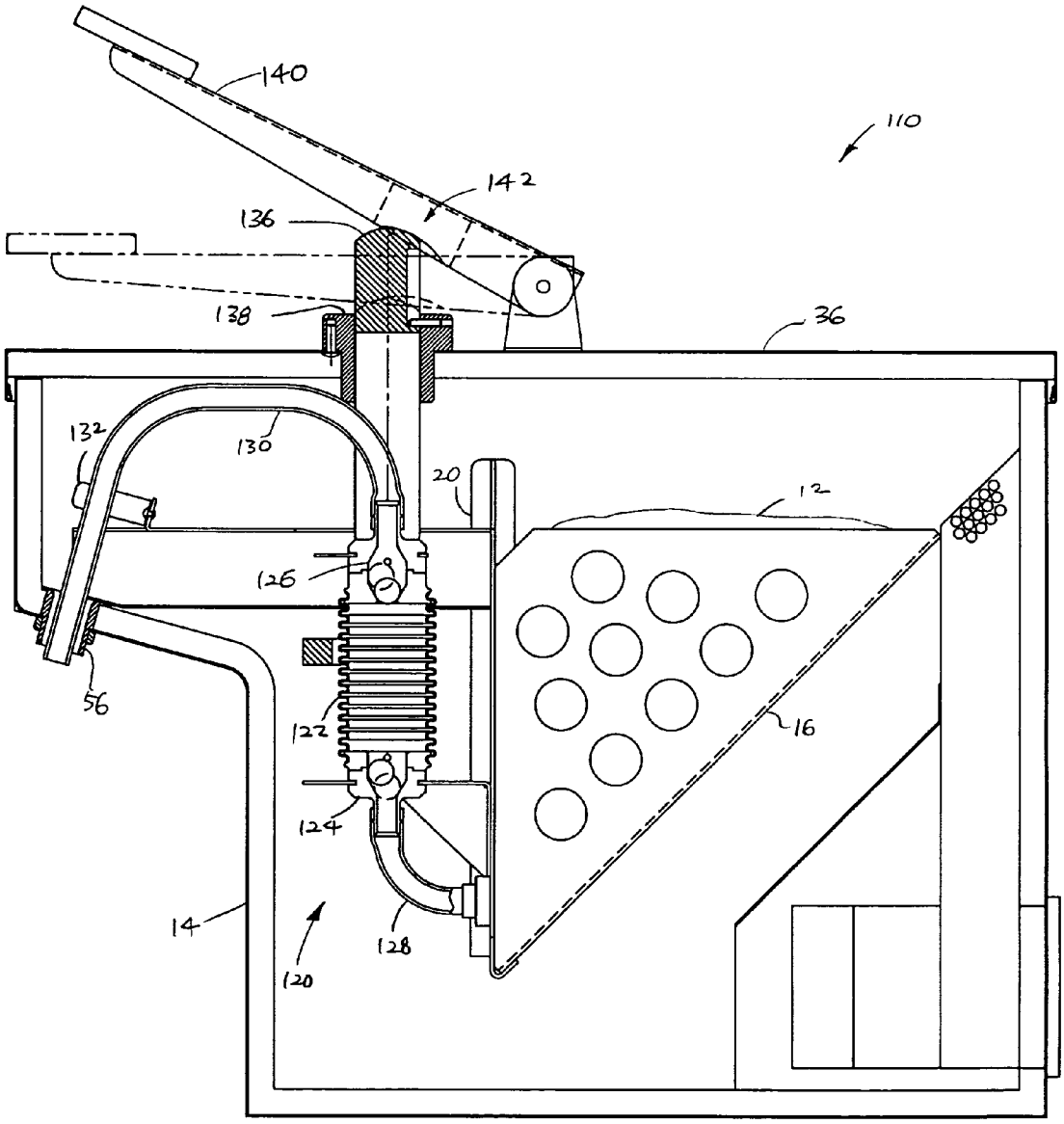
FIG. 5 is a side elevational view of the dispensing apparatus of FIG. 4.

FIGS. 4–6 show another dispensing apparatus 110 employing a different pump assembly which includes the pump body with valves, tubes, and connectors. The pump assembly is connected to the product package. The entire pump assembly and the product package are disposable so that they may be discarded after each use and replaced by a new pump assembly and product package without the need for cleaning. The same reference characters are used for common components between the embodiment of FIGS. 1–2 and the embodiment of FIGS. 4–6.

As seen in FIGS. 4–6, the pump assembly 120 includes a pump body 122 having an inlet check valve 124 and an outlet check valve 126. An inlet tube 128 is connected between the inlet check valve 124 and the product package 12. An outlet tube 130 is connected between the outlet check valve 126 and the hood 56. A tube retainer spring clip 132 may be used to secure the outlet tube 130. The pump body 122 is a bellows pump. The check valves 124, 126 may be any suitable valves, including valves that are particularly adapted for use with products having large particulates. Such valves are described in U.S. patent application Ser. No. 10/601,257, filed Jun. 19, 2003, the entire disclosure of which is incorporated herein by reference. A plunger 136 is connected to the pump body 122 and is movable to actuate the pump 122. An alignment and retaining pin 138 secures the plunger 136 to the top cover 36. The top cover 36 may be secured to the container 14 by top cover latches 139. For ease of operation, a hand lever 140 is coupled with the plunger 136 at a plunger saddle block 142, and is rotatably mounted to the top cover 36 to pivot and move the plunger 136 to actuate the pump 122. The pump 122 is resiliently biased upward by one or more return springs 146. The up and down movement of the plunger 136 and pump body 122 may be guided by one or more guide rods 150. The pump assembly 120 slides in and out of the pump holder bulkhead panel 20 for easy installation and removal.

Figure 3:
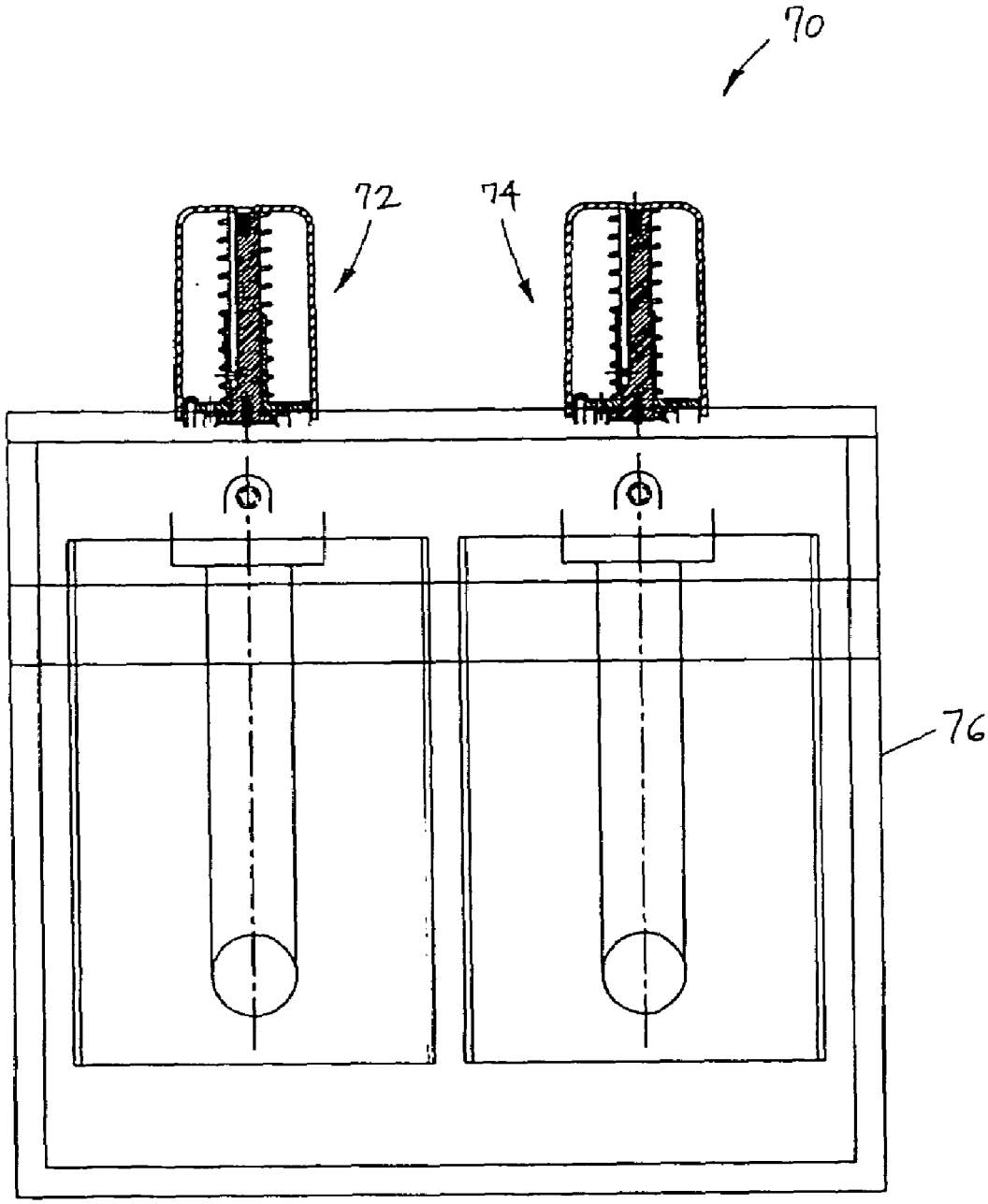
FIG. 3 is an elevational view showing two dispensing devices provided in a single container according to another embodiment of the present invention.

The above-described arrangements of apparatus and methods are merely illustrative of applications of the principles of this invention and many other embodiments and modifications may be made without departing from the spirit and scope of the invention as defined in the claims. For example, FIG. 3 shows an embodiment of the apparatus 70 in which two dispensing devices 72, 74 are provided in a single container 76 to be heated by the heated air in the container 76. The scope of the invention should, therefore, be determined not with reference to the above description, but instead should be determined with reference to the appended claims along with their full scope of equivalents.

What is claimed is:

1. An apparatus for dispensing a flowable product from a product package through a dispensing outlet at or above a preset elevated temperature, the apparatus comprising:

a container in which to dispose the product package, the container including a gas inlet and a gas outlet;

a dispensing outlet to dispense the flowable product from the product package, the dispensing outlet being disposed adjacent the gas outlet;

a pump coupled between the product package and the dispensing outlet to pump the flowable product from the product package to the dispensing outlet; and a heated gas flow controller configured to direct a heated gas flow in the container to heat the product package, the pump, and the dispensing outlet, the heated gas flow including gas flowing into the container via the gas inlet and gas flowing out of the chamber via the gas outlet adjacent the dispensing outlet;

wherein the heated gas flow controller comprises a fan heater which draws outside air from outside the container via the gas inlet heats the air, and circulates the heated air in the container; and wherein a portion of the heated air exits the container through the gas outlet and a remaining portion of the heated air is recirculated through a return air plenum to the fan heater.

2. The apparatus of claim 1 wherein the product package is disposed in a package compartment in the container with space around the product package to permit the heated gas flow through the space around the product package.

3. The apparatus of claim 1 wherein the pump includes a flow channel disposed between the product package and the dispensing outlet, and wherein the flow channel is disposed inside the container.

4. The apparatus of claim 1 wherein the gas outlet comprises an annular outlet disposed around the dispensing outlet.

5. The apparatus of claim 1 wherein the fan heater generates a positive pressure inside the container which is higher than a pressure outside the container.

6. The apparatus of claim 1 further comprising a filter disposed at the gas inlet.

7. An apparatus for dispensing a flowable product from a product package through a dispensing outlet at or above a preset elevated temperature, the apparatus comprising:

a container in which to dispose the product package, the container including a gas inlet and a gas outlet;

a dispensing outlet to dispense the flowable product from the product package;

a pump coupled between the product package and the dispensing outlet to pump the flowable product from the product package to the dispensing outlet;

a heater configured to heat air in the container; and a fan configured to draw outside air from outside the container via the gas inlet which is heated by the heater, and to circulate the heated air in the container along flow paths adjacent the product package, the pump, and the dispensing outlet;

wherein a portion of the heated air exits the container through the gas outlet and a remaining portion of the heated air is recirculated through a return air plenum to the heater.

8. The apparatus of claim 7 wherein the gas outlet comprises an annular outlet disposed around the dispensing outlet.

9. The apparatus of claim 7 wherein the product package is disposed in a package compartment in the container with space around the product package to permit the heated gas flow through the space around the product package.

10. An apparatus for dispensing a flowable product from a product package through a dispensing outlet at or above a preset elevated temperature, the apparatus comprising:

a container in which to dispose the product package, the container including a gas inlet and a gas outlet;

a dispensing outlet to dispense the flowable product from the product package;

a pump coupled between the product package and the dispensing outlet to pump the flowable product from the product package to the dispensing outlet;

a heater configured to heat air in the container; and means for generating a positive pressure inside the container which is higher than a pressure outside the container to cause the heated air in the container to flow adjacent the product package, the pump, and the dispensing outlet;

means for recirculating a portion of the heated air in the container to the heater.

11. The apparatus of claim 10 wherein the gas outlet comprises an annular outlet disposed around the dispensing outlet.

* * * * *